US007305910B1

(12) United States Patent
Bermes

(10) Patent No.: US 7,305,910 B1
(45) Date of Patent: Dec. 11, 2007

(54) PROCESS AND TOOL FOR CUTTING MONOFILAMENT LINE

(75) Inventor: Steven P. Bermes, Spencerville, IN (US)

(73) Assignee: Novae Corporation, Fort Wayne, IN (US)

( * ) Notice: Subject to any disclaimer, the term of this patent is extended or adjusted under 35 U.S.C. 154(b) by 38 days.

(21) Appl. No.: 10/964,944

(22) Filed: Oct. 14, 2004

Related U.S. Application Data

(62) Division of application No. 10/078,981, filed on Feb. 20, 2002, now abandoned.

(51) Int. Cl.
*B26D 7/08* (2006.01)
*B26B 3/00* (2006.01)

(52) U.S. Cl. ..... 83/17; 30/289

(58) Field of Classification Search ..... 30/294, 30/282, 280, 289, 124, 114, 127, 278, 120.1, 30/315; 7/106; 43/4, 44.98; 112/289, 295, 112/299, 292, 298; 83/17–19
See application file for complete search history.

(56) References Cited

U.S. PATENT DOCUMENTS

| | | | | |
|---|---|---|---|---|
| 342,532 | A | | 5/1886 | O'Brien |
| 962,285 | A | | 6/1910 | Witt |
| 1,049,874 | A | | 1/1913 | Kramer |
| 1,050,118 | A | | 1/1913 | Farrell |
| 1,496,228 | A | | 6/1924 | Jones |
| 1,720,502 | A | | 7/1929 | Whelan |
| 2,109,303 | A | | 2/1938 | Ogletree |
| 2,163,064 | A | | 6/1939 | Rominger |
| 2,240,675 | A | | 5/1941 | Seligner |
| 2,653,776 | A | | 9/1953 | Rochow |
| 3,128,023 | A | | 4/1964 | Cook |
| 3,757,626 | A | * | 9/1973 | Kulp ..... 83/542 |
| 3,836,059 | A | | 9/1974 | Lauen et al. |
| 3,990,148 | A | * | 11/1976 | Rienzo, Sr. ..... 30/287 |
| 4,053,979 | A | * | 10/1977 | Tuthill et al. ..... 606/138 |
| 4,111,089 | A | * | 9/1978 | Montaruli ..... 83/542 |
| 5,022,577 | A | | 6/1991 | Fike |
| 5,046,253 | A | | 9/1991 | Ireland |
| 5,123,320 | A | | 6/1992 | Hochfeld |
| 5,172,841 | A | | 12/1992 | Friedman |
| 5,182,874 | A | | 2/1993 | Powell |
| 5,359,776 | A | | 11/1994 | Glazar |
| 5,639,506 | A | * | 6/1997 | Smyth ..... 427/2.31 |
| 5,666,731 | A | | 9/1997 | Rungren |
| 5,718,365 | A | | 2/1998 | Palmer |

(Continued)

*Primary Examiner*—Stephen Choi
(74) *Attorney, Agent, or Firm*—George Pappas

(57) ABSTRACT

A process of cutting monofilament line using a cutting tool including a tool body having a cavity for insertion of a bent portion of the monofilament line. A cutting blade is provided in the cavity and a pair of opposing walls in the cavity are located generally parallel to and on either side of the cutting blade. For cutting, the monofilament line is bent into a U-shape portion which is inserted into the cavity with the legs of the U-shape portion adjacent the respective opposing walls, thereby placing the outer exterior surface of the monofilament line at the bottom of the U-shape portion in tension and the inner exterior surface of the bottom of the U-shape portion in compression. As the U-shaped portion is inserted into the cavity, the outer exterior surface at the bottom of the U-shape portion is placed against the cutting blade thereby cutting the monofilament line.

7 Claims, 4 Drawing Sheets

U.S. PATENT DOCUMENTS 5,737,842 A * 4/1998 Freedman ..... 30/280
5,809,656 A 9/1998 Lindberg
5,946,997 A 9/1999 Nicholson, Jr.
D422,188 S 4/2000 Lira-Nunez
6,058,608 A 5/2000 Wruck
6,096,151 A * 8/2000 Edwards et al. ..... 156/174
6,145,427 A 11/2000 Smith
6,615,495 B1 9/2003 Evens et al.

* cited by examiner

PROCESS AND TOOL FOR CUTTING MONOFILAMENT LINE

This application is a divisional application and claims priority under 35 U.S.C. §§ 120, 121 of application Ser. No. 10/078,981 filed Feb. 20, 2002 ABN the disclosure of which is hereby incorporated herein by reference.

TECHNICAL FIELD

The present invention generally relates to a method and tool for cutting monofilament line and, more particularly, to an improved method and tool for more easily and efficiently cutting monofilament line.

BACKGROUND OF THE INVENTION

Monofilament line or string is today very commonly used in many applications including as trimmer line and fishing line. Monofilament line is typically made of a polymer material including, for example, nylon, kevlar and plastic. Monofilament line exhibits exceptional strength and wear characteristics, and is relatively inexpensive. In view of these properties, monofilament line is difficult to cut, especially in larger diameters. Typically, the monofilament line is cut by pulling a knife into the line or by using a pair of scissors or snips. In either case, a significant force is required to force the cutting edge therethrough and cut the monofilament line. This is inconvenient and can be tiresome as well as dangerous, especially when the cutting process is often repeated such as when replacing the monofilament line in grass trimmers.

Accordingly, a need exists for an improved process and tool whereby monofilament line can be cut more efficiently and easily.

SUMMARY OF THE INVENTION

The principal object of the present invention is to provide a new and improved process and tool for efficiently and easily cutting polymer monofilament line.

Briefly, the present invention is directed to a new and improved process of cutting monofilament line by first bending the monofilament line thereby placing one side or exterior surface thereof in tension and the opposite side or exterior surface thereof in compression. Thereafter, the tensioned side or exterior surface is placed in contact with a cutting blade or edge thereby cutting the line. Because the exterior surface first coming in contact with the cutting edge is in tension, the line is easily split by the cutting edge starting at the tensioned exterior surface. Simultaneously, the opposite side of the line which is in compression causes the line to be pushed toward the cutting edge. Thus, the monofilament line is quickly and easily cut with little effort by merely bending the line and placing the tensioned surface of the bent portion of the line against the cutting edge.

The present invention is further directed to a cutting tool for practicing the process of cutting monofilament line. The tool includes a body having a cavity and a cutting blade located within the cavity. A pair of opposing walls in the cavity are located generally parallel with the cutting blade. For cutting, the monofilament line is bent into a U-shape and inserted into the cavity placing each of the legs of the U-shape portion against the respective opposing walls and the bottom of the U-shape portion exterior surface which is in tension against the cutting blade. The opposing cavity walls act to retain the monofilament line in a U-shape while slidingly inserting the monofilament line into the cavity and against the cutting blade.

Preferably, the cavity further includes retaining walls located perpendicular to the cutting blade so that, when slidingly inserting the monofilament line in the cavity, the legs of the U-shape are retained against the opposing walls and are prevented from twisting with respect to the cutting blade. In this fashion the legs and bottom portion of the monofilament U-shape portion are retained in a plane generally perpendicular to the blade cutting edge.

Preferably, the cutting tool body is made of plastic by injection molding with the cutting blade adapted to be captured in the cavity during the molding process, or is made of an aluminum extrusion with the cutting blade being press fit and frictionally retained in the cavity. The cutting tool can be integrally formed or otherwise fixed to a spool of monofilament line thereby allowing the user to easily remove from the spool and cut the monofilament line to the desired length.

In one form thereof, the present invention is directed to a process of cutting monofilament line including the steps of bending the monofilament line and placing an exterior surface thereof in tension, and placing the tensioned exterior surface in contact with a cutting edge and cutting the monofilament line.

In one form thereof, the present invention is directed to a process of cutting a monofilament line with a cutting tool including a tool body having a cavity extending therein, a cutting blade in the cavity and a pair of opposing walls in the cavity located generally parallel with the cutting blade. The process includes the steps of bending the monofilament line into a U-shape portion and inserting the U-shape portion into the tool cavity placing each of the legs of the U-shape portion against the respective opposing walls, and placing the outer exterior surface at the bottom of the U-shape portion in tension and the inner exterior surface of the U-shape portion in compression. The outer exterior surface at the bottom of the U-shape portion is then placed against the cutting blade thereby cutting the monofilament line.

In one form thereof, the present invention is directed to a tool for cutting monofilament line and includes a tool body, a cavity extending into the tool body and a cutting blade in the cavity. A pair of opposing walls are provided in the cavity and are located generally parallel with the cutting blade. A monofilament line can be cut by bending into a U-shape portion and inserting into the cavity placing each of the legs of the U-shape portion against the respective opposing walls and the bottom of the U-shape portion against the cutting blade.

In one form thereof the present invention is directed to a tool for cutting monofilament line. The tool includes a pair of opposing walls. A cutting blade is located between and parallel with the opposing walls, whereby a monofilament line can be cut by bending into a U-shape portion and placing each of the legs of the U-shape portion against the respective opposing walls and the bottom of the U-shape portion against the cutting blade.

BRIEF DESCRIPTION OF THE DRAWINGS

The above mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein, illustrate preferred embodiments of the invention in one form thereof and such exemplifications are not to be construed as limiting the scope of the disclosure or the scope of the invention in any manner.

DESCRIPTION OF THE PREFERRED EMBODIMENT

Figure 1:
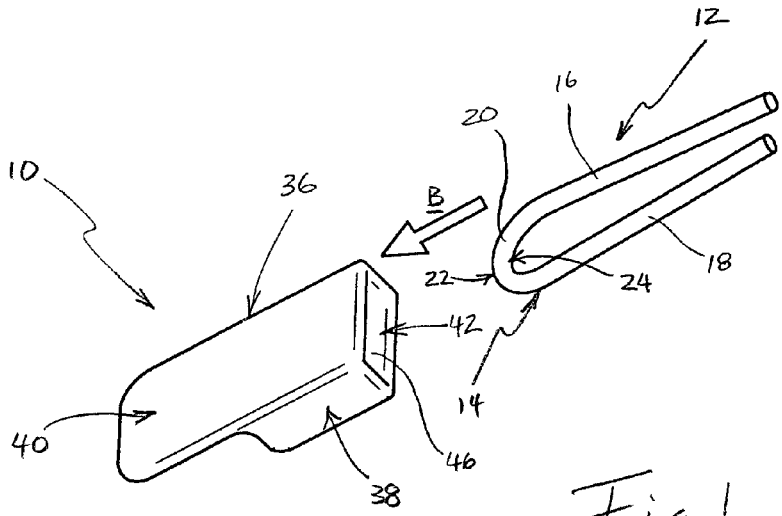
FIG. 1 is a perspective view of a monofilament line cutting tool constructed in accordance with the principles of the present invention and depicting a monofilament line bent in a U-shape portion being inserted into the cutting tool.
Figure 2:
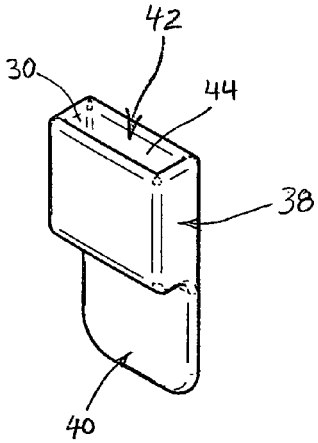
FIG. 2 is a perspective view of the cutting tool shown in FIG. 1.

Referring initially to FIG. 1, there is shown a monofilament line cutting tool 10 constructed in accordance with the principles of the present invention and adapted for cutting a polymer monofilament line 12. Monofilament line or string 12 is typically made of a polymer such as, for example, nylon, kevlar or plastic. As shown, line 12 typically has a circular outer shape, although it could have a rectangular, square or other polygon exterior shape. Further, line 12 is typically solid as shown, although it could be tubular.

Figure 14:
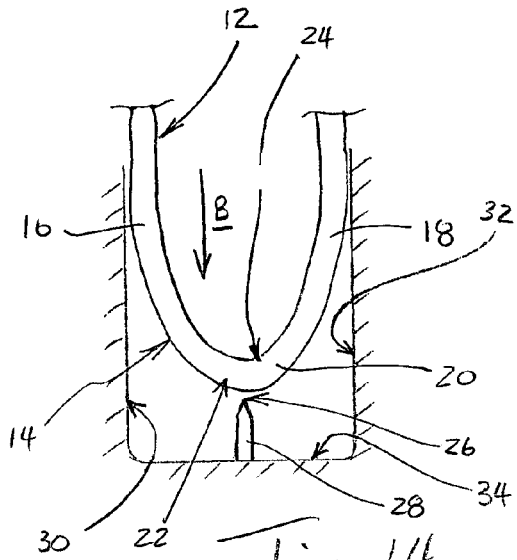
FIG. 14 is a diagrammatic view showing a monofilament line bent into a U-shape and prior to placing in contact with the cutting edge.
Figure 15:
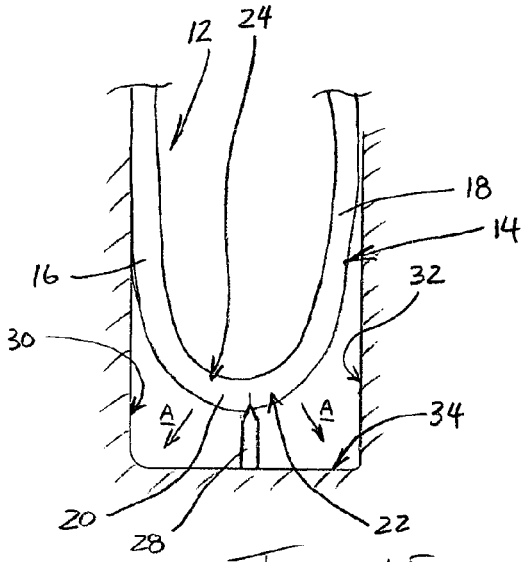
FIG. 15 is a diagrammatic view similar to FIG. 14 but depicting the monofilament line contacting the cutting edge; and, FIG. 16 is a diagrammatic view similar to FIG. 15 but depicting the monofilament line after the line has been cut.
Figure 16:
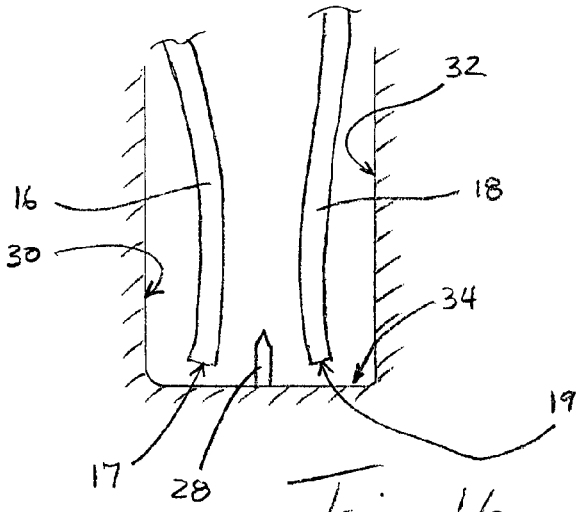

As diagrammatically depicted in FIGS. 14-16, the process of cutting line 12 includes the steps of first bending the line into a U-shape portion 14 having legs 16 and 18 and a bottom portion 20. In this fashion, the outer exterior surface 22 of the bottom portion 20 is placed in tension, and the inner exterior surface 24 of the bottom portion 20 is placed in compression.

Thereafter, the bottom portion 20 of the U-shape portion 14 is placed in contact with the cutting edge 26 of cutting blade 28 as best depicted in FIG. 15. At that point in time, the line 12 starts to split as shown starting at the outer exterior surface 22 and toward the inner exterior surface 24. It should be noted that, because the outer exterior surface 22 is in tension, the splitting or cutting of the line 12 by cutting edge 26 is accomplished with relatively little force. Additionally, because the inner exterior surface 24 is in compression, the legs 16 and 18 tend to be pushed outwardly in a direction indicated by arrows A, and thus, also toward the cutting edge 26. Therefore, upon placement of the outer exterior surface 22 against the cutting edge 26, the compressive forces on the inner side and the exterior surface 24 on the bottom portion 20, in general, cause the legs 16 and 18 to be forced toward the cutting edge 26 until the legs 16 and 18 are cut or severed from one another as depicted in FIG. 16.

Preferably opposing walls 30 and 32 are provided and are located parallel with the cutting blade edge 26. Opposing walls 30 and 32 essentially retain the monofilament line 12 in a U-shape as the line is moved toward the cutting blade 28 as indicated by arrow B. More particularly, the walls 30 and 32 tend to retain the legs 16 and 18 of the U-shape portion 14 generally parallel with one another as they are slidingly moved along the walls 30 and 32 toward the cutting blade 28. Preferably, the blade 28 is located equidistant between the opposing walls 30 and 32 so that the cutting edge 26 will come in contact with about the center of the bottom portion 20 of the U-shape portion 14. Additionally, the distance between the walls 30 and 32 is such that the U-shape portion 14 will readily fit therebetween without detrimentally frictionally engaging walls 30 and 32. As can be appreciated, this will depend on the diameter and flexibility of the monofilament line 12 which would allow the line to generally easily be bent into a U-shape portion. As the diameter of the monofilament line increases, so will the distance between the opposing walls 30 and 32. For example, in a preferred embodiment, for cutting monofilament grass trimmer line which is about 0.080 inches in diameter, the preferred distance between opposing walls 30 and 32 is about 0.63 inch.

As also shown in FIGS. 14-16 the cutting blade 28 projects from a bottom wall 34 a sufficient distance so as to penetrate through the monofilament line 12 and allow the cut ends 17 and 19 of respective legs 16 and 18 sufficient room to move in the directions as indicated by the arrows A and to the sides of blade 28 beyond the cutting edge 26 as depicted in FIG. 16. Similar to the distance between walls 30 and 32, the height of blade 28 extending above the bottom wall 34 will depend on the diameter of the monofilament line 12 intended to be cut, and as the diameter increases, so will the required height of blade 28. In the preferred embodiment for cutting monofilament grass trimmer line, the cutting edge 26 of blade 28 preferably extends to a height of about 0.25 to 0.50 inches above the bottom wall 34.

Figure 5:
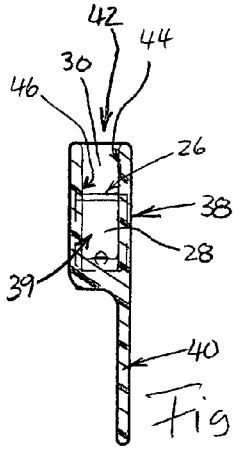
FIG. 5 is a cross sectional view of the cutting tool shown in FIG. 3 taken generally along line 5-5.
Figure 3:
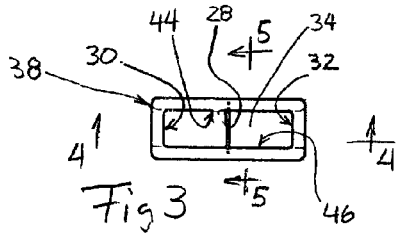
FIG. 3 is a top plan view of the cutting tool shown in FIG. 1.
Figure 4:
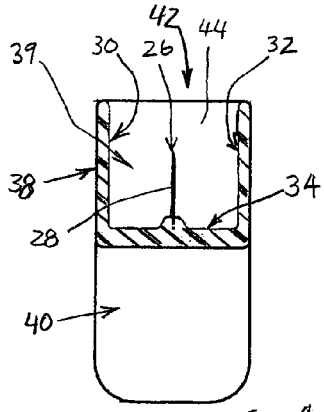
FIG. 4 is a cross sectional view of the cutting tool shown in FIG. 3 taken generally along line 4-4.
Figure 6:
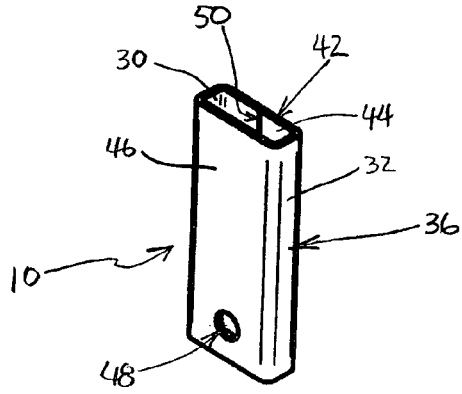
FIG. 6 is a perspective view of a second embodiment of a monofilament line cutting tool constructed in accordance with the principles of the present invention.
Figure 8:
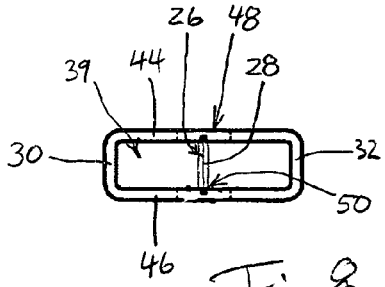
FIG. 8 is a top plan view of the cutting tool shown in FIG. 6.
Figure 7:
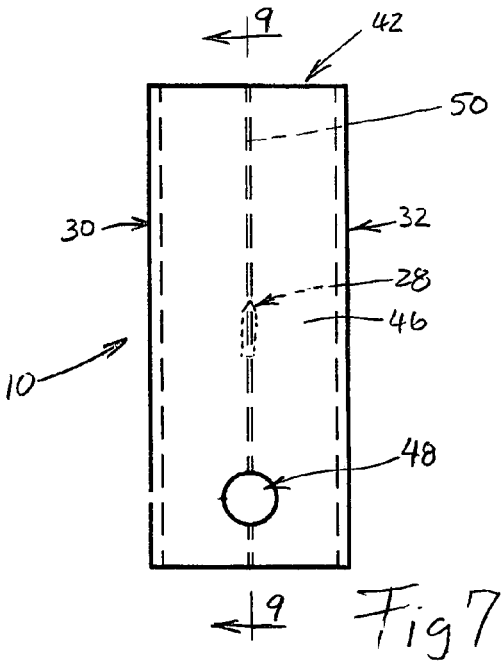
FIG. 7 is a front elevation view of the cutting tool shown in FIG. 6.
Figure 9:
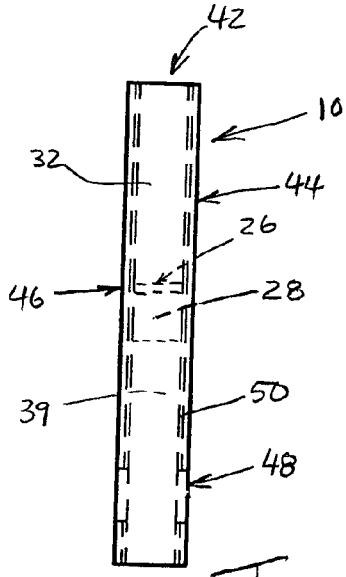
FIG. 9 is a side elevation view of the cutting tool shown in FIG. 7.
Figure 10:
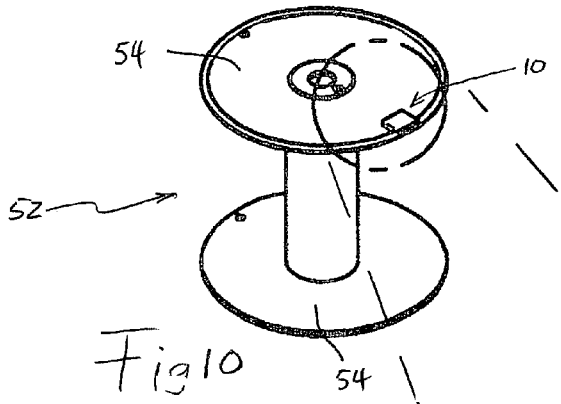
FIG. 10 is yet another embodiment of a monofilament line cutting tool placed on a spool for monofilament line and constructed in accordance with the principles of the present invention.
Figure 11:
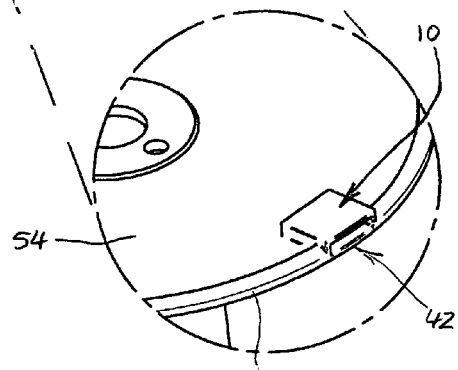
FIG. 11 is an exploded view of the designated area shown in FIG. 10.
Figure 12:
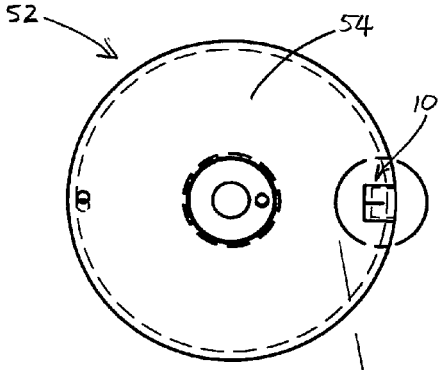
FIG. 12 is a top plan view of the spool shown in FIG. 10.
Figure 13:
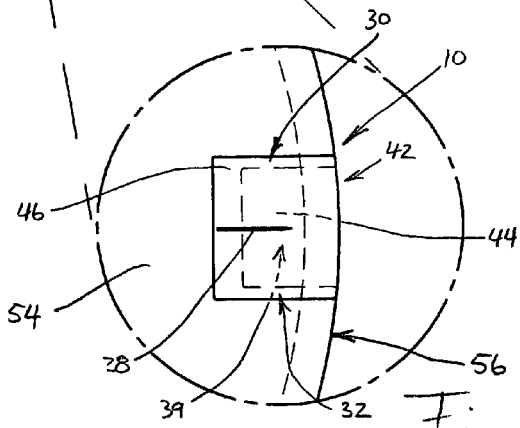
FIG. 13 is an exploded view of the designated area shown in FIG. 12.

The cutting tool 10 shown in FIGS. 1-5 is preferably made of plastic by injection molding and having a body 36. Body 36 includes an integrally formed cavity portion 38 and a thin holding portion 40. The holding portion 40, as shown, can be grasped between a uses thumb and fingers for use of the cutting tool 10 as shown and described. Cavity portion 38 includes a cavity 39 having an opening 42 and being generally defined by opposing walls 30 and 32, retaining walls 44 and 46, and bottom wall 34. A cutting blade 28 having a cutting edge 26 is provided in the cavity and is retained therein by embedding during the injection molding of the body 36. As shown in FIGS. 3-5, blade 28 is similar to a razor blade and is essentially embedded in retaining walls 44 and 46 and in the bottom wall 34.

In operation, the cutting tool of FIGS. 1-5 is used by bending the monofilament line 12 in a U-shape portion 14 and inserting into the cavity through opening 42 and with the legs 16 and 18 being generally adjacent the opposing walls 30 and 32. Upon insertion, the bottom portion 20 of U-shape portion 14 is placed in contact with cutting edge 26 of blade 28 for thereby cutting the monofilament line 12 as more fully described hereinabove. It is noted that retaining walls 44 and 46 are located generally perpendicular to the cutting blade 28 so that, as the U-shape portion 14 is inserted into the cavity 39, the U-shape portion leg 16 and 18 and the bottom portion 22 thereof are prevented from twisting and are retained in a plane generally perpendicular to the cutting blade 28. Retaining wall 44 and 46 also serve to align and retain the U-shape portion legs 16 and 18 adjacent the opposing walls 30 and 32. As should now be appreciated, by merely bending the monofilament line 12 into a U-shape and inserting into the cavity 39, the line 12 is readily and easily severed.

In a second embodiment shown in FIGS. 6-9, the cutting tool body 36 is made of an aluminum extrusion which is rectangularly shaped and thereby forming the opposing walls 30 and 32 and the retaining walls 44 and 46. Key chain holes 48 are provided and extend through the retaining walls 44 and 46 and are adapted for receiving a key chain therethrough. Retaining walls 44 and 46 are provided with longitudinally extending slots 50 whereat the blade 28 is received and retained. More particularly blade 28 is inserted through the cavity opening 42 and press fit between the retaining walls 44 and 46 and preferably within the longitudinally extending slots 50. Thus, blade 28 is frictionally retained within the cavity between the opposing retaining walls 44 and 46. It is noted that, although longitudinal extending slots are desirable for guiding the blade 28 during assembly, it is contemplated that the slots 50 can be eliminated and the cutting blade 28 merely pressed into position for frictionally engaging the walls 44 and 46 and being retained therein as shown. In operation, the tool body embodiment of FIGS. 6-9 can be used similarly to the cutting tool of FIGS. 1-5 by merely bending the monofilament line 12 into a U-shape portion 14 and inserting into the cavity opening 42 for thereby cutting the monofilament line 12.

In the embodiment shown in FIGS. 10-13 the cutting tool is substantially similar to that shown in FIGS. 1-5 but is affixed to a spool 52 which is adapted to retain monofilament line such as that used for grass trimmers. More particularly, spool 52 includes disk shaped retaining walls 54 preferably made of plastic and the cutting tool 10 is integrally formed therewith during the injection molding process of the disk shaped retaining walls 54. The cutting tool 10 similarly includes a cavity opening 42 extending into a cavity 39 formed by opposing walls 30 and 32, retaining walls 40 and 46, and bottom wall 34. It is noted that one of the retaining walls 44 is a common or shared wall with the disk shaped tool retaining wall 54. As shown, preferably the cavity 39 extends radially inwardly from the peripheral edge 56 of the spool retaining wall 54. Accordingly, monofilament line on spool 54 can readily be removed therefrom and bent into a U-shape portion and inserted in the cutting tool 10 on the disk shaped retaining wall 54 for thereby obtaining a desired length of monofilament line 12.

While the invention has been described as having specific embodiments, it will be understood that it is capable of further modifications. This application is, therefore, intended to cover any variations, uses, or adaptions of the invention following the general principles thereof and including such departures from the present disclosure as come within known or customary practice in the art to which this invention pertains and fall within the limits of the appended claims.

What is claimed is:

1. A process of cutting monofilament line with a cutting tool including a tool body, a cutting blade, and a wall adjacent to the cutting blade, said process of cutting comprising the steps of:

bending the monofilament line into a U-shape portion and inserting the U-shape portion into the tool body placing at least one of legs of the U-shape portion against the wall and placing an outer exterior surface at a bottom of the U-shape portion in tension and an inner exterior surface of the bottom of the U-shape portion in compression; and, placing the outer exterior surface at the bottom of the U-shape portion against the cutting blade thereby cutting the monofilament line.

2. The process of claim 1 wherein the cutting tool further includes retaining walls located perpendicular to the cutting blade and wherein, during said step of inserting, the legs of the U-shape portion are retained against the wall.

3. The process of claim 1 wherein, the cutting tool further includes retaining walls located perpendicular to the cutting blade and wherein, during said step of inserting, the legs and bottom of the U-shape portion are retained in a plane generally perpendicular to the cutting blade.

4. The process of claim 1 wherein the tool body is located on a spool of monofilament trimmer line and wherein the monofilament line is cut to a length sufficient for use in a trimmer.

5. The process of claim 1 wherein the legs of the U-shape are retained generally equidistant from the cutting edge.

6. The process of claim 1 wherein, after the monofilament line is cut, the cut ends of the legs of the U-shape extend beyond the cutting edge.

7. The process of claim 1 wherein the legs of the U-shape portion are retained generally equidistant from the cutting edge and wherein, after the monofilament line is cut, the cut ends of the legs of the U-shape extend beyond the cutting edge.

* * * * *